US012018880B2

(12) United States Patent
Shibuya et al.

(10) Patent No.: US 12,018,880 B2
(45) Date of Patent: Jun. 25, 2024

(54) REFRIGERATION APPARATUS FOR SHIPPING, AND SHIPPING CONTAINER

(71) Applicant: DAIKIN INDUSTRIES, LTD., Osaka (JP)

(72) Inventors: Kento Shibuya, Osaka (JP); Hirotaka Tagawa, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 17/890,832

(22) Filed: Aug. 18, 2022

(65) Prior Publication Data

US 2022/0404087 A1 Dec. 22, 2022

Related U.S. Application Data

(63) Continuation of application No. PCT/JP2021/006894, filed on Feb. 24, 2021.

(30) Foreign Application Priority Data

Mar. 6, 2020 (JP) ..... 2020-038721

(51) Int. Cl.
*F25D 19/00* (2006.01)
*F24F 1/52* (2011.01)
(Continued)

(52) U.S. Cl.
CPC ..... *F25D 19/003* (2013.01); *F24F 1/52* (2013.01); *F25B 40/00* (2013.01); *F25D 11/003* (2013.01);
(Continued)

(58) Field of Classification Search
CPC ..... F25D 11/003; F25D 11/02; F25D 11/00; F25D 19/003; F24F 1/52; F24F 1/58; F28F 19/02; B60P 3/20
See application file for complete search history.

(56) References Cited

U.S. PATENT DOCUMENTS 2,746,268 A 5/1956 Sellstrom
2,791,098 A 5/1957 Kleist
(Continued)

FOREIGN PATENT DOCUMENTS

CN 209819811 U 12/2019
JP 61-99071 A 5/1986
(Continued)

OTHER PUBLICATIONS

English translation of International Preliminary Report on Patentability and Written Opinion of the International Searching Authority for International Application No. PCT/JP2021/006894, dated Sep. 15, 2022.
(Continued)

*Primary Examiner* — Tho V Duong
*Assistant Examiner* — For K Ling
(74) *Attorney, Agent, or Firm* — Birch, Stewart, Kolasch & Birch, LLP

(57) ABSTRACT

A casing is provided with a partition portion extending in a vertical direction so as to partition an outdoor space and an accommodation chamber from each other. The partition portion has an opening for providing communication between the outdoor space and the accommodation chamber. An eaves portion is provided above the opening.

21 Claims, 8 Drawing Sheets

(51) Int. Cl.

| | |
|---|---|
| ***F25B 40/00*** | (2006.01) |
| ***F25D 11/00*** | (2006.01) |
| ***F25D 17/06*** | (2006.01) |
| ***F28F 19/02*** | (2006.01) |

(52) U.S. Cl.
CPC ..... *F25D 17/06* (2013.01); *F28F 19/02* (2013.01); *F25D 2400/12* (2013.01)

(56) References Cited

U.S. PATENT DOCUMENTS

| | | | | |
|---|---|---|---|---|
| 2,949,751 | A * | 8/1960 | Henrikson | F25D 19/003 62/428 |
| 3,871,188 | A * | 3/1975 | Vold | F25D 19/003 62/448 |
| 4,424,684 | A * | 1/1984 | Waldschmidt | F25D 19/003 62/448 |
| 4,503,907 | A * | 3/1985 | Tanaka | F28F 19/02 165/909 |
| 4,551,986 | A | 11/1985 | Anderson et al. | |
| 4,748,824 | A | 6/1988 | Wakabayashi et al. | |
| 4,802,342 | A * | 2/1989 | Gustafson | B60H 1/3232 62/262 |
| 6,318,098 | B1 | 11/2001 | Boxum | |
| 9,273,896 | B2 * | 3/2016 | Sao | F25D 23/003 |
| 2002/0174671 | A1 | 11/2002 | Wilkinson | |
| 2006/0042275 | A1 * | 3/2006 | Tanaka | F25D 11/003 62/126 |
| 2008/0178624 | A1 | 7/2008 | Zedney | |
| 2013/0233524 | A1 * | 9/2013 | Taras | F28D 1/047 165/121 |
| 2014/0157794 | A1 * | 6/2014 | McGann | F25D 11/003 62/3.2 |
| 2019/0041115 | A1 | 2/2019 | Rau | |
| 2019/0195516 | A1 * | 6/2019 | Xue | F24F 1/16 |

FOREIGN PATENT DOCUMENTS

| | | | |
|---|---|---|---|
| JP | 6-86976 | B2 | 11/1994 |
| JP | 2524187 | B2 | 8/1996 |
| JP | 10-160334 | A | 6/1998 |
| WO | WO-2016166409 | A1 * | 10/2016 |

OTHER PUBLICATIONS

International Search Report for PCT/JP2021/006894 mailed on Apr. 6, 2021.
Written Opinion of the International Searching Authority for PCT/JP2021/006894 mailed on Apr. 6, 2021.
Extended European Search Report for corresponding European Application No. 21765157.9, dated Jul. 12, 2023.

* cited by examiner

REFRIGERATION APPARATUS FOR SHIPPING, AND SHIPPING CONTAINER

CROSS REFERENCE TO RELATED APPLICATIONS

This application is a Continuation of PCT International Application No. PCT/JP2021/006894, filed on Feb. 24, 2021, which claims priority under 35 U.S.C. 119(a) to Patent Application No. 2020-038721, filed in Japan on Mar. 6, 2020, all of which are hereby expressly incorporated by reference into the present application.

TECHNICAL FIELD

The present disclosure relates to a refrigeration apparatus for transport and a transport container.

BACKGROUND ART

Patent Document 1 discloses a refrigeration apparatus for transport. The refrigeration apparatus for transport is provided in a container body. As illustrated in FIG. 2 of Patent Document 1, a casing of a refrigeration apparatus for transport is provided with a front panel (partition portion). The partition portion partitions between an outdoor space and an accommodation chamber. A heat exchanger and a fan are disposed in the accommodation chamber. A plurality of holes are provided in the partition portion. When the fan is operated, outdoor air enters the accommodation chamber through the plurality of holes. The air that has entered the accommodation chamber passes through the heat exchanger and is then blown out to the outdoor space.

CITATION LIST

Patent Document

Patent Document 1: U.S. Patent Application Publication No. 2019/0041115 specification

SUMMARY

A first aspect is directed to a refrigeration apparatus for transport, including:

a heat exchanger (32);

a casing (11) forming an accommodation chamber (S2) for housing the heat exchanger (32) therein, the casing (11) being provided with a partition portion (16) extending in a vertical direction so as to partition an outdoor space (O) and the accommodation chamber (S2) from each other, the partition portion (16) having an opening (73, 80) for providing communication between the outdoor space (O) and the accommodation chamber (S2); and an eaves portion (91) above the opening (73, 80).

DESCRIPTION OF EMBODIMENTS

An embodiment of the present disclosure will be described below with reference to the drawings. The following embodiment is merely an exemplary one in nature, and is not intended to limit the scope, applications, or use of the present invention.

Embodiment

Figure 1:
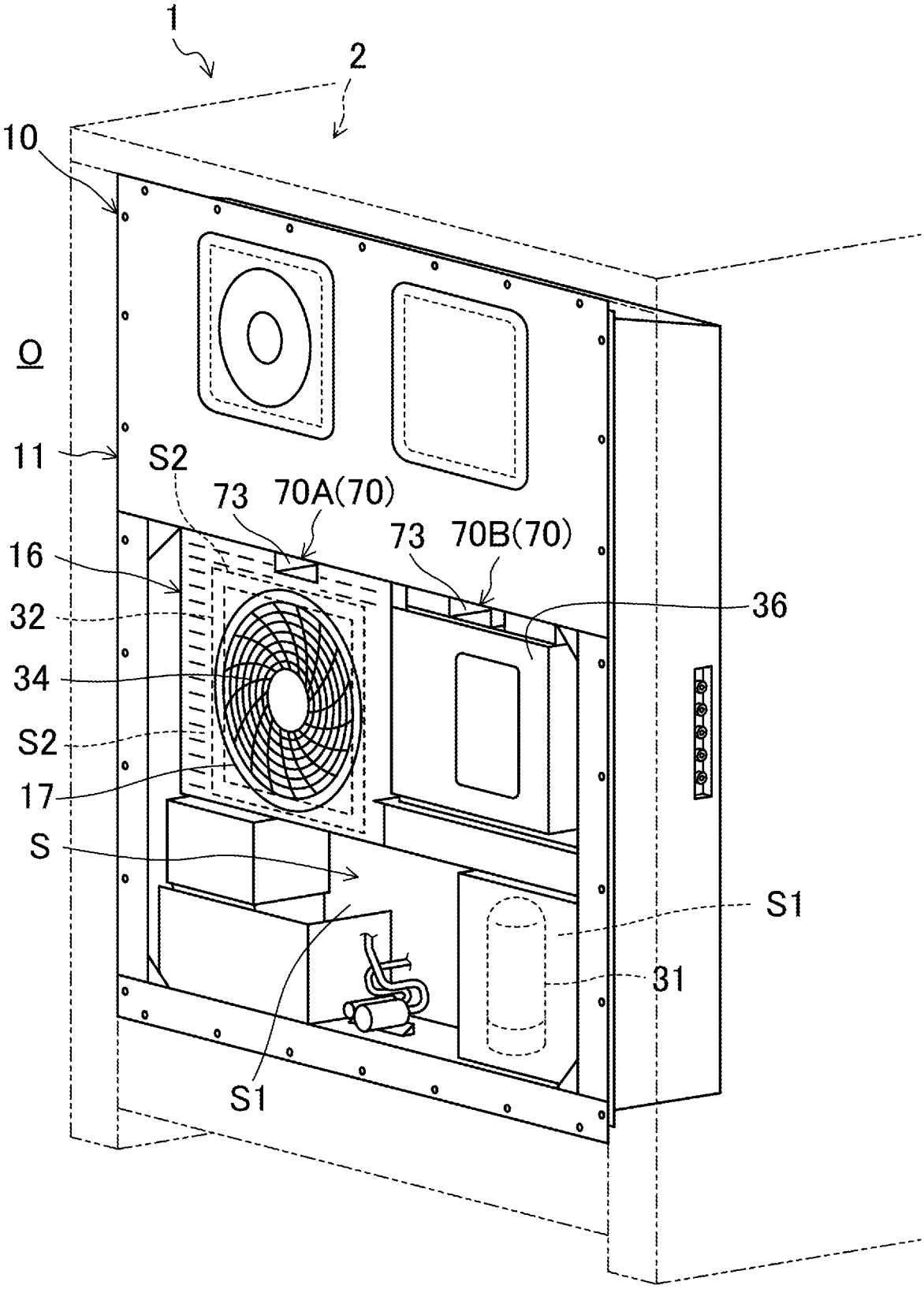
FIG. 1 is a perspective view illustrating a transport container according to an embodiment as viewed from the front side.
Figure 2:
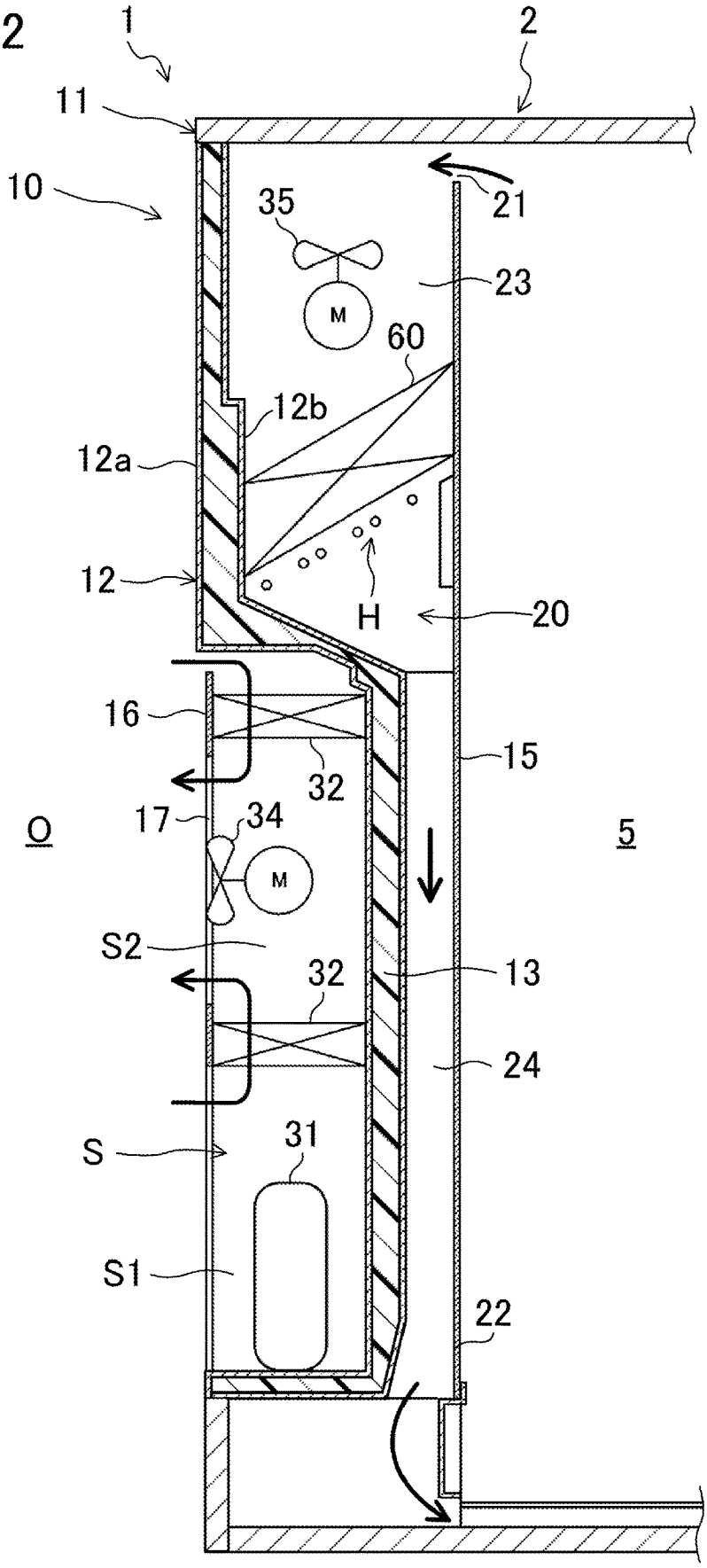
FIG. 2 is a vertical cross-sectional view schematically illustrating an internal structure of the transport container according to the embodiment.

The present disclosure relates to a transport container (1). As illustrated in FIGS. 1 and 2, the transport container (1) includes a container body (2) and a refrigeration apparatus for transport (10) provided in the container body (2). The transport container (1) is used for marine transportation. The transport container (1) is conveyed by a marine transporter, such as a ship.

<Container Body>

The container body (2) is formed in a hollow box-like shape. The container body (2) is formed to be horizontally long. The container body (2) has an opening formed at one end in the longitudinal direction. The refrigeration apparatus for transport (10) blocks the opening of the container body (2). Inside the container body (2), a storage space (5) for storing articles to be transported is provided. Articles to be transported will be stored in the storage space (5). The temperature of air in the storage space (5) (also referred to as "inside air") is adjusted by the refrigeration apparatus for transport (10)

<Refrigeration Apparatus for Transport>

The refrigeration apparatus for transport (10) is attached to the opening of the container body (2). The refrigeration apparatus for transport (10) includes a casing (11) and a refrigerant circuit (C).

<Casing>

As schematically illustrated in FIG. 2, the casing (11) includes a division wall (12) and a partition plate (15).

An internal flow path (20) is formed inside the division wall (12). Air for cooling the articles to be transported in the storage space (5) flows through the internal flow path (20). An external chamber (S) is formed outside the division wall (12). The division wall (12) separates the internal flow path (20) from the external chamber (S).

The division wall (12) includes an exterior wall (12*a*) and an interior wall (12*b*). The exterior wall (12*a*) is located outside the container body (2). The interior wall (12*b*) is located inside the container body (2). The exterior wall (12*a*) and the interior wall (12*b*) are made of, for example, an aluminum alloy.

The exterior wall (12*a*) closes the opening of the container body (2). The exterior wall (12*a*) is attached to a peripheral portion of the opening of the container body (2). A lower portion of the exterior wall (12*a*) bulges toward the inside of the container body (2). The external chamber (S) is formed in a portion of the exterior wall (12*a*) bulging toward the inside of the container body (2).

The interior wall (12*b*) faces the exterior wall (12*a*). The interior wall (12*b*) has a shape conforming to the exterior wall (12*a*). The interior wall (12*b*) is disposed at a distance from the exterior wall (12*a*). The lower portion of the interior wall (12*b*) bulges toward the inside of the container body (2). A heat insulator (13) is provided between the interior wall (12*b*) and the exterior wall (12*a*).

The partition plate (15) is disposed on the inner side of the container body (2) with respect to the interior wall (12*b*). The internal flow path (20) is formed between the division wall (12) and the partition plate (15). An inflow port (21) is formed between an upper end of the partition plate (15) and a top panel of the container body (2). An outflow port (22) is formed between a lower end of the partition plate (15) and a lower end of the division wall (12). The internal flow path (20) extends from the inflow port (21) to the outflow port (22).

The internal flow path (20) includes an upper flow path (23) and a lower flow path (24). The upper flow path (23) is an upper portion of the internal flow path (20). The lower flow path (24) is a lower portion of the internal flow path (20). The lower flow path (24) is located at a position corresponding to the bulging portion of the division wall (12).

<Components of Refrigerant Circuit>

The refrigerant circuit (C) has refrigerant filled therein. The refrigerant circulates in the refrigerant circuit (C) to perform a vapor compression refrigeration cycle. The refrigerant circuit (C) includes a compressor (31), an external heat exchanger (32), an expansion valve (33), an internal heat exchanger (60), and a refrigerant pipe connecting these components.

The compressor (31) is disposed in a first space (S1) corresponding to a lower portion of the external chamber (S). The compressor (31) sucks and compresses a low-pressure refrigerant. The compressor (31) discharges the compressed refrigerant as a high-pressure refrigerant.

The external heat exchanger (32) is disposed in a second space (S2) corresponding to an upper portion of the external chamber (S). The external heat exchanger (32) is a fin-and-tube heat exchanger. The external heat exchanger (32) is a so-called four-side heat exchanger. The external heat exchanger (32) functions as a condenser or a radiator. The external heat exchanger corresponds to a heat exchanger of the present disclosure.

The internal heat exchanger (60) is arranged in the internal flow path (20). The internal heat exchanger (60) is supported between the division wall (12) and the partition plate (15). The internal heat exchanger (60) is disposed above the bulging portion of the interior wall (12*b*). The internal heat exchanger (60) is a fin-and-tube heat exchanger. The internal heat exchanger (60) functions as an evaporator.

<External Fan>

The refrigeration apparatus for transport (10) includes a single external fan (34). The external fan (34) is arranged in the second space (S2) of the external chamber (S). The external fan (34) is arranged inside the four heat-exchange portions of the external heat exchanger (32). The external fan (34) is a propeller fan.

When the external fan (34) operates, the outside air flows from the outside to the inside of the external heat exchanger (32). The air inside the external heat exchanger (32) is blown out of the casing (11).

<Internal Fan>

The refrigeration apparatus for transport (10) includes two internal fans (35). The internal fans (35) are arranged in the upper flow path (23) of the internal flow path (20). The internal fans (35) are arranged above the internal heat exchanger (60). The internal fans (35) are arranged upstream of the internal heat exchanger (60) in the direction of air flow. The internal fans (35) are propeller fans. The internal fans (35) may be reduced to one, or may be increased to three or more.

When the internal fans (35) operate, the operation causes the internal air in the storage space (5) to flow into the upper flow path (23) of the internal flow path (20) via the inflow port (21). Air in the upper flow path (23) of the internal flow path (20) passes through the internal heat exchanger (60) and flows through the lower flow path (24). The air in the lower flow path (24) flows out into the storage space (5) via the outflow port (22).

<Heater>

The refrigeration apparatus for transport (10) includes a heater (H). The heater (H) is arranged below the internal heat exchanger (60). The heater (H) is attached to a lower portion of the internal heat exchanger (60). When the heater (H) operates, the internal heat exchanger (60) is heated. The heat of the heater (H) melts frost attached to the internal heat exchanger (60). The heater (H) is used to defrost the internal heat exchanger (60).

<Electric Component Box>

As illustrated in FIG. 1, the refrigeration apparatus for transport (10) includes an electric component box (36). The electric component box (36) is arranged in the second space (S2) of the external chamber (S). The electric component box (36) houses therein a reactor, a power supply circuit board, a control board, and the like.

<Details of Refrigerant Circuit>

Figure 3:
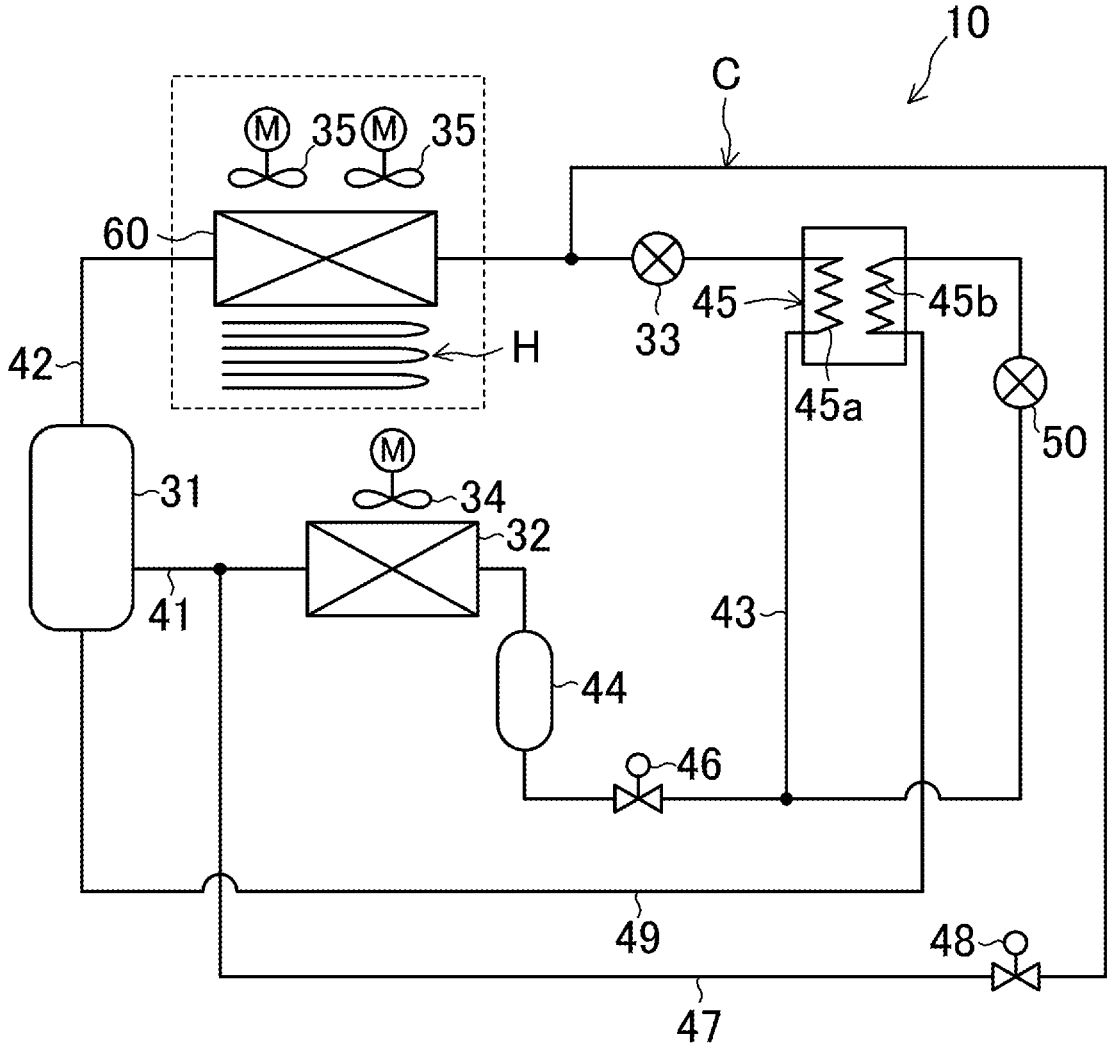
FIG. 3 is a piping system diagram of a refrigerant circuit of a refrigeration apparatus for transport according to the embodiment.

Details of the refrigerant circuit (C) will be described with reference to FIG. 3. In FIG. 3, components surrounded by a broken line square are internal ones, and the other components are external ones.

The refrigerant circuit (C) includes, as main components, the compressor (31), the external heat exchanger (32), the expansion valve (33), and the internal heat exchanger (60). The expansion valve (33) is an electronic expansion valve having a variable opening degree.

The refrigerant circuit (C) has a discharge pipe (41) and a suction pipe (42). One end of the discharge pipe (41) is connected to a discharge portion of the compressor (31). The other end of the discharge pipe (41) is connected to a gas end of the external heat exchanger (32). One end of the suction pipe (42) is connected to a suction portion of the compressor (31). The other end of the suction pipe (42) is connected to a gas end of the internal heat exchanger (60).

The refrigerant circuit (C) includes a liquid pipe (43), a receiver (44), a cooling heat exchanger (45), a first on-off valve (46), a connecting pipe (47), a second on-off valve (48), an injection pipe (49), and an injection valve (50).

One end of the liquid pipe (43) is connected to a liquid end of the external heat exchanger (32). The other end of the liquid pipe (43) is connected to a liquid end of the internal heat exchanger (60). The receiver (44) is provided for the liquid pipe (43). The receiver (44) is a container that stores the refrigerant.

The cooling heat exchanger (45) has a first flow path (45*a*) and a second flow path (45*b*). The cooling heat exchanger (45) exchanges heat between the refrigerant in the first flow path (45*a*) and the refrigerant in the second flow path (45*b*). The cooling heat exchanger (45) is, for example, a plate heat exchanger. The first flow path (45*a*) is a portion of the liquid pipe (43). The second flow path (45*b*) is a portion of the injection pipe (49). The cooling heat exchanger (45) cools the refrigerant flowing through the liquid pipe (43).

The first on-off valve (46) is arranged in the liquid pipe (43) to be located between the receiver (44) and the first flow path (45*a*). The first on-off valve (46) is an electromagnetic valve that can be opened and closed.

The connecting pipe (47) allows a high-pressure line and a low-pressure line of the refrigerant circuit (C) to communicate with each other. One end of the connecting pipe (47) is connected to the discharge pipe (41). The other end of the connecting pipe (47) is connected to the liquid pipe (43) to be located between the expansion valve (33) and the internal heat exchanger (60).

The second on-off valve (48) is provided for the connecting pipe (47). The second on-off valve (48) is an electromagnetic valve that can be opened and closed.

The injection pipe (49) introduces the refrigerant into an intermediate-pressure portion of the compressor (31). One end of the injection pipe (49) is connected to the liquid pipe (43) to be located between the receiver (44) and the first flow path (45*a*). The other end of the injection pipe (49) is connected to the intermediate-pressure portion of the compressor (31). The intermediate pressure, which is the pressure of the intermediate-pressure portion, is a pressure in a range between the suction pressure and the discharge pressure of the compressor (31).

The injection valve (50) is arranged upstream of the second flow path (45*b*) in the injection pipe (49). The injection valve (50) is an electronic expansion valve having a variable opening degree.

<Operation of Refrigeration Apparatus for Transport>

Basic operation of the refrigeration apparatus for transport (10) will be described below. When the refrigeration apparatus for transport (10) is in operation, the compressor (31), the external fan (34), and the internal fans (35) operate. The first on-off valve (46) opens. The second on-off valve (48) is closed. The opening degree of the expansion valve (33) is adjusted. The opening degree of the injection valve (50) is adjusted.

The refrigerant compressed by the compressor (31) flows through the external heat exchanger (32). The refrigerant in the external heat exchanger (32) dissipates heat to the outside air to condense. The condensed refrigerant passes through the receiver (44). Part of the refrigerant that has passed through the receiver (44) flows through the first flow path (45*a*) of the cooling heat exchanger (45). The remaining of the refrigerant that has passed through the receiver (44) flows through the injection pipe (49), and is decompressed to the intermediate pressure by the injection valve (50). The decompressed refrigerant is introduced into the intermediate-pressure portion of the compressor (31).

In the cooling heat exchanger (45), the refrigerant in the second flow path (45*b*) absorbs heat from the refrigerant in the first flow path (45*a*) to evaporate. This cools the refrigerant in the first flow path (45*a*). In other words, the degree of subcooling of the refrigerant flowing through the first flow path (45*a*) increases.

The refrigerant cooled in the cooling heat exchanger (45) is decompressed to a low pressure by the expansion valve (33). The decompressed refrigerant flows through the internal heat exchanger (60). The refrigerant in the internal heat exchanger (60) absorbs heat from the inside air to evaporate. Thus, the internal heat exchanger (60) cools the inside air. The evaporated refrigerant is sucked into the compressor (31) and compressed again.

The air in the container body (2) circulates through the storage space (5) and the internal flow path (20). The internal heat exchanger (60) cools the inside air in the internal flow path (20). Thus, the air in the storage space (5) can be cooled and adjusted to a predetermined temperature.

<Front Panel and Peripheral Structure Thereof>

A front panel (16) of the casing (11) and its peripheral structure will be described in detail. The terms "front," "rear," "right," "left," "upper," and "lower" described below are based on a case where the front panel (16) of the casing (11) is viewed from the front.

<Front Panel>

Figure 4:
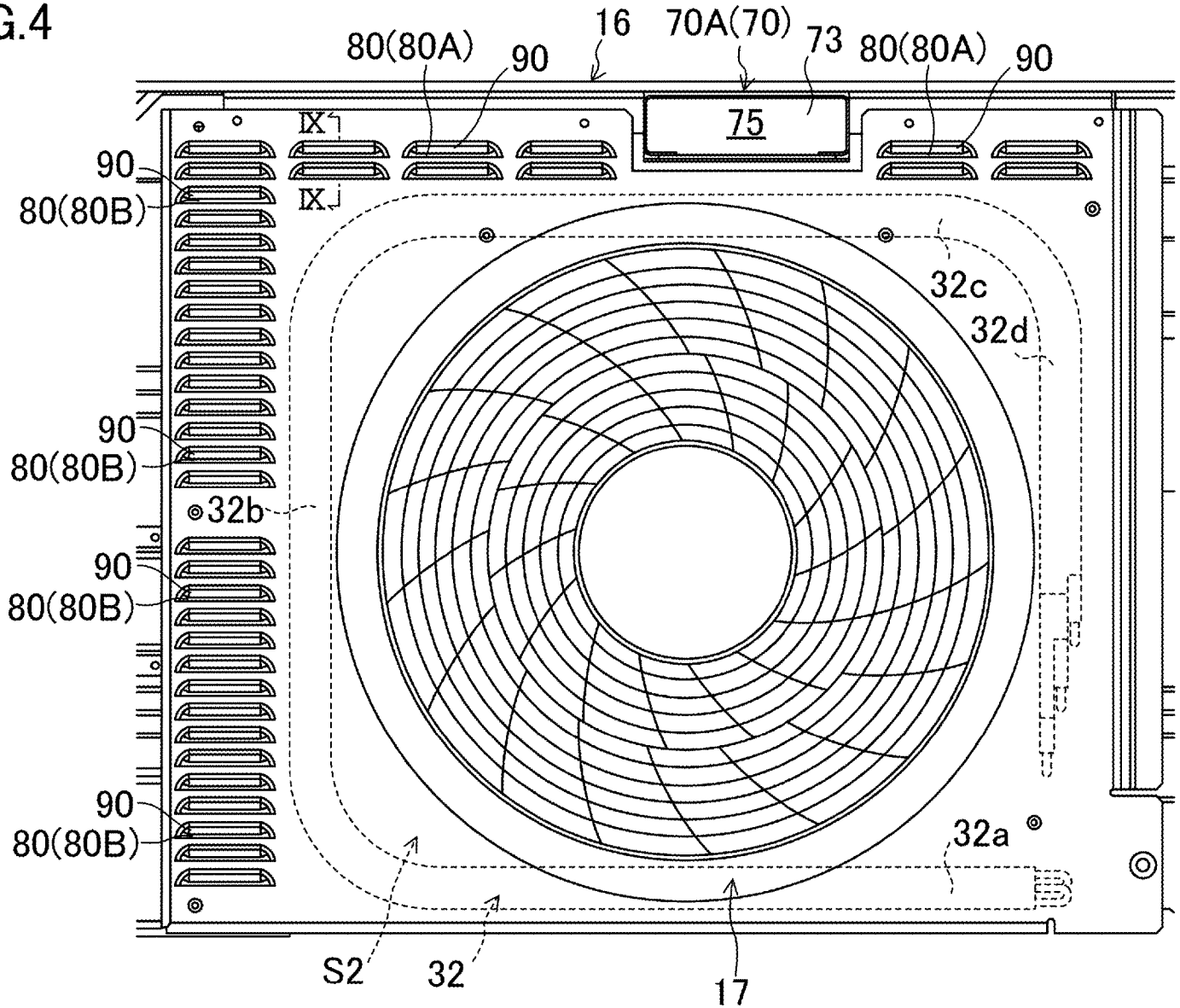
FIG. 4 is an enlarged front view of the vicinity of a front panel according to the embodiment.

As illustrated in FIGS. 1 and 4, a front panel (16) is provided to a front surface of the casing (11), which is one of side surfaces of the casing (11). The front panel (16) extends in a vertical direction so as to partition the outdoor space (O) and the second space (S2) from each other. The second space (S2) is formed behind the front panel (16). The external heat exchanger (32) and the external fan (34) are disposed in the second space (S2). The second space (S2) corresponds to the accommodation chamber (S2). The front panel (16) corresponds to a partition portion.

<Outlet Grille>

The front panel (16) is provided with an outlet grille (17). The outlet grille (17) is disposed at the center of the front panel (16). The outlet grille (17) is located in front of the external fan (34). The outlet grille (17) provides communication between the second space (S2) and the outdoor space (O). In the second space (S2), the air having passed through the external heat exchanger (32) is blown out into the outdoor space (O) through the outlet grille (17).

<External Heat Exchanger>

The external heat exchanger (32) is disposed opposite to the outdoor space (O) with respect to the front panel (16). The external heat exchanger (32) is provided in the second space (S2) so as to surround the outlet grille (17). The external heat exchanger (32) has a substantially quadrangular shape in a front view viewed from the outdoor space (O) toward the second space (S2). More specifically, the external heat exchanger (32) has a quadrangular shape having one side with an omitted end in the front view.

The external heat exchanger (32) includes heat transfer tubes and a large number of fins through which the heat transfer tubes pass. The heat transfer tubes are bent into a substantially quadrangular shape in the front view. The large number of fins are aligned in the extending direction of the heat transfer tubes. The heat transfer tubes and fins are made of a copper material.

The external heat exchanger (32) includes four heat-exchange portions (32*a*, 32*b*, 32*c*, 32*d*) each including a heat transfer tube and fins. To be specific, the external heat exchanger (32) includes a first heat-exchange portion (32*a*), a second heat-exchange portion (32*b*), a third heat-exchange portion (32*c*), and a fourth heat-exchange portion (32*d*). The first heat-exchange portion (32*a*) corresponds to a lower surface of the external heat exchanger (32). The second heat-exchange portion (32*b*) corresponds to a left surface of the external heat exchanger (32). The third heat-exchange portion (32*c*) corresponds to an upper surface of the external heat exchanger (32). The fourth heat-exchange portion (32*d*) corresponds to a right surface of the external heat exchanger (32). In the external heat exchanger (32), the first heat-exchange portion (32*a*), the second heat-exchange portion (32*b*), the third heat-exchange portion (32*c*), and the fourth heat-exchange portion (32*d*) are sequentially connected. Between an end portion of the first heat-exchange portion (32*a*) and an end portion of the fourth heat-exchange portion (32*d*), a gap corresponding to the above-described omitted portion is formed.

A coating film made of a cationic paint (hereinafter referred to as a cationic coating film) is provided on the surface of the external heat exchanger (32). More specifically, an assembly of the external heat exchanger (32) is immersed in a raw material containing a cationic paint. A direct current is applied to the assembly in this state, thereby forming a cationic coating film on the surface of the external heat exchanger (32). More specifically, a cationic coating film is formed on the surfaces of the fins, heat transfer tubes, tube plates, or the like.

The cationic paint is excellent in corrosion resistance and rust prevention. The transport container (1) is transported by sea on a ship or the like. The cationic coating film retards rusting or corrosion of the external heat exchanger (32) due to the influence of salt water.

<Fork Pocket>

As illustrated in FIG. 1, a pair of fork pockets (70) are provided on the front surface of the casing (11). The pair of fork pockets (70) includes a first fork pocket (70A) and a second fork pocket (70B). As shown in FIG. 4, the first fork pocket (70A) is provided in the front panel (16) which serves as the partition portion. The first fork pocket (70A) is disposed above the outlet grille (17). The second fork pocket (70B) is disposed above the electric component box (36). The first fork pocket (70A) and the second fork pocket (70B) are located at the same height.

Figure 5:
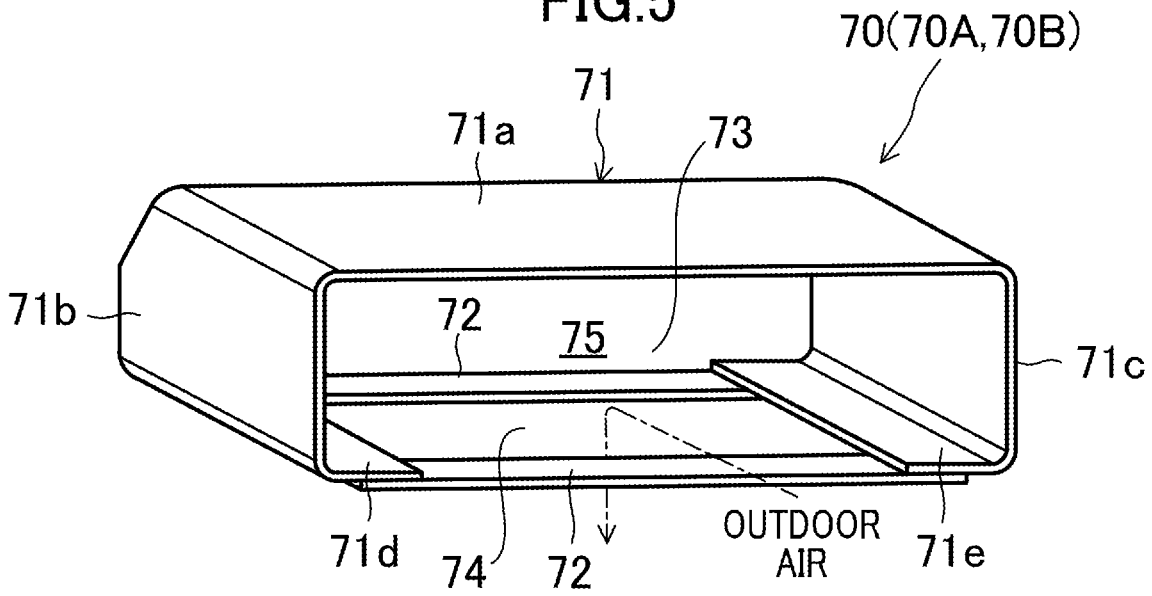
FIG. 5 is a perspective view of a fork pocket according to the embodiment as viewed from the front side.

As illustrated in FIG. 5, each of the fork pockets (70) is formed in a horizontally long quadrangular shape in the front view. The fork pocket (70) is formed in a horizontally long rectangular tubular shape. The fork pocket (70) includes a main body (71) and a pair of long plates (72). The main body (71) is formed in a horizontally long rectangular tubular shape having an open part at its lower part. The pair of long plates (72) are attached to the open part of the main body (71).

The main body (71) includes an upper plate (71*a*), a first side plate (71*b*), a second side plate (71*c*), a first bottom plate (71*d*), and a second bottom plate (71*e*). The first side plate (71*b*) extends downward from a left end of the upper plate (71*a*). The second side plate (71*c*) extends downward from a right end of the upper plate (71*a*). The first bottom plate (71*d*) extends rightward from a lower end of the first side plate (71*b*). The second bottom plate (71*e*) extends leftward from a lower end of the second side plate (71*c*). The first bottom plate (71*d*) and the second bottom plate (71*e*) are separated from each other in the horizontal direction.

The pair of long plates (72) are arranged at front and rear portions of the fork pocket (70). One of the pair of long plates (72) is located at the front edge of the main body (71), and the other is located at the rear edge of the main body (71). The pair of long plates (72) extend in the horizontal direction across the first side plate (71*b*) and the second side plate (71*c*).

As illustrated in FIG. 1, an insertion opening (73) is provided on the front side of each fork pocket (70). A pair of claws of a forklift can be inserted into these insertion openings (73). A pair of claws of a forklift are inserted into respective insertion openings (73). When the pair of claws inserted are raised and lowered, the transport container (1) can be lifted up and down.

Each fork pocket (70) has a communication hole (74). The communication hole (74) is defined by the first bottom plate (71*d*), the second bottom plate (71*e*), and the two long plates (72). The communication hole (74) opens downward. An air passage (75) is formed in the fork pocket (70) from the insertion opening (73) to the communication hole (74). When the external fan (34) operates, the operation causes outdoor air to flow into each of the fork pockets (70) through the insertion opening (73) and flow through the air passage (75). Air in the air passage (75) flows into the external heat exchanger (32) through the communication hole (74). In FIG. 5, the flow of the outdoor air is indicated by an arrow of a one dot chain line.

<Suction Port>

Figure 6:
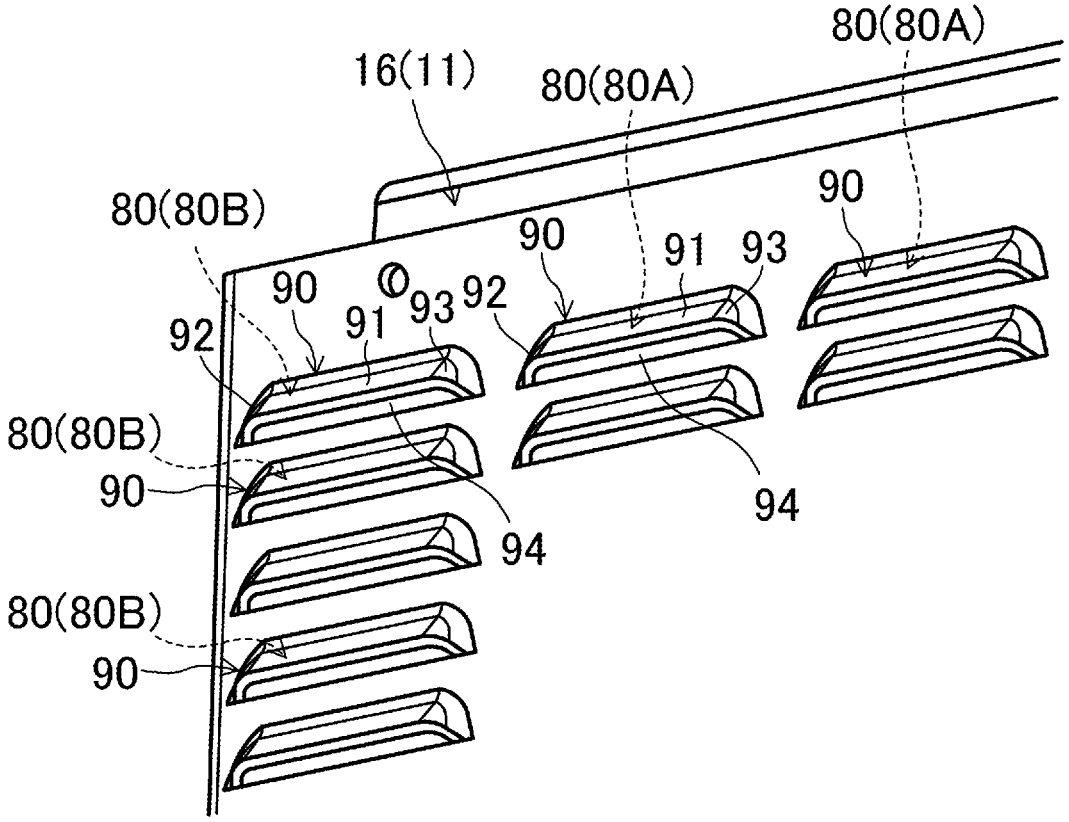
FIG. 6 is an enlarged perspective view of a main part of the front panel according to the embodiment.

As shown in FIGS. 4 and 6, a plurality of suction ports (80) are provided in the front panel (16). The plurality of suction ports (80) correspond to openings for providing communication between the outdoor space (O) and the second space (S2). The plurality of suction ports (80) include a plurality of first suction ports (80A) and a plurality of second suction ports (80B). Structures of the first suction port (80A) and the second suction port (80B) are basically the same.

In the front view of the front panel (16), a plurality of first suction ports (80A) are located above the external heat exchanger (32). A plurality of second suction ports (80B) are located on the left side of the external heat exchanger (32). In the front view of the front panel (16), the plurality of first suction ports (80A) are located above the third heat-exchange portion (32*c*). In the front view of the front panel (16), the plurality of second suction ports (80B) are located on the left side of the second heat-exchange portion (32*b*).

On the front panel (16), two rows of five first suction ports (80A) arranged side by side are aligned in the vertical direction. The five first suction ports (80A) in each row include three on the left side and two on the right side of the first fork pocket (70A). In the front panel (16), hole groups each includes 15 second suction ports (80B) arranged in the vertical direction are arranged in the vertical direction at predetermined intervals.

Figure 7:
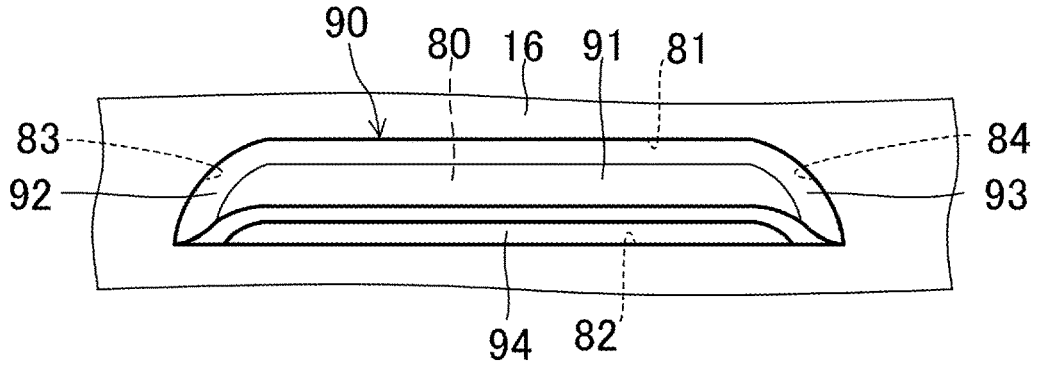
FIG. 7 is an enlarged front view of a light shielding portion according to the embodiment.
Figure 8:
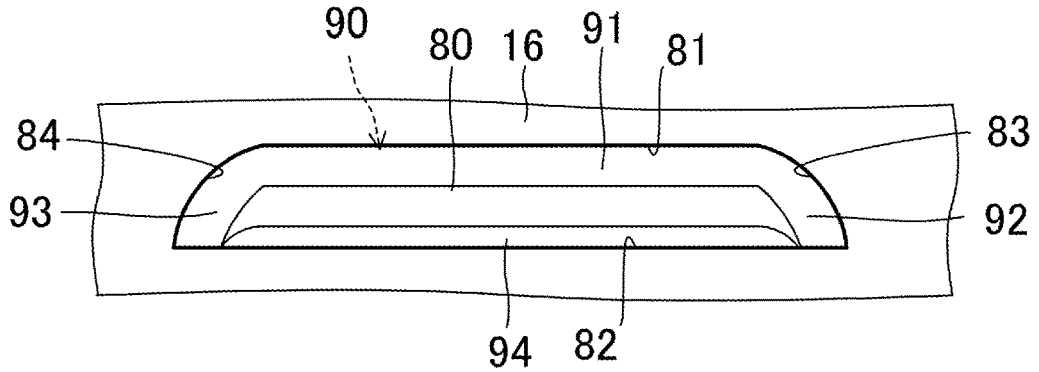
FIG. 8 is an enlarged rear view of the light shielding portion according to the embodiment.

As illustrated in FIG. 7 (a rear view of the front panel (16)), the suction port (80) extends in the horizontal direction. The suction port (80) has a substantially trapezoidal shape. The suction port (80) has an upper edge portion (81), a lower edge portion (82), a first side edge portion (83), and a second side edge portion (84).

The upper edge portion (81) corresponds to an upper side of the suction port (80). The lower edge portion (82) corresponds to a lower side of the suction port (80). The left-right length of the upper edge portion (81) is shorter than the left-right length of the lower edge portion (82). The first side edge portion (83) is formed at a left end portion of the suction port (80). The second side edge portion (84) is formed at a right end portion of the suction port (80). The first side edge portion (83) is formed in a substantially arc shape bulging obliquely leftward. The second side edge portion (84) is formed in a substantially arc shape bulging obliquely rightward.

<Light Shielding Portion>

Details of the light shielding portion (90) will be described with reference to FIGS. 6 to 9. The front panel (16) is provided with a plurality of light shielding portions (90). The light shielding portions (90) are provided for the respective suction ports (80). In other words, one light shielding portion (90) is provided for each of the plurality of first suction ports (80A) and each of the plurality of second suction ports (80B). The light shielding portion (90) is formed by a press working process on the front panel (16). The light shielding portion (90) has an eaves portion (91) and two sidewall portions (92, 93).

<Eaves Portion>

The eaves portion (91) is disposed above an associated one of the suction ports (80). The eaves portion (91) is provided at an upper edge portion (81) of the suction port (80). The eaves portion (91) is provided along the upper edge portion (81) of the suction port (80) in the horizontal direction. The eaves portion (91) is provided from one end to the other end of the upper edge portion (81) in the horizontal direction.

Figure 9:
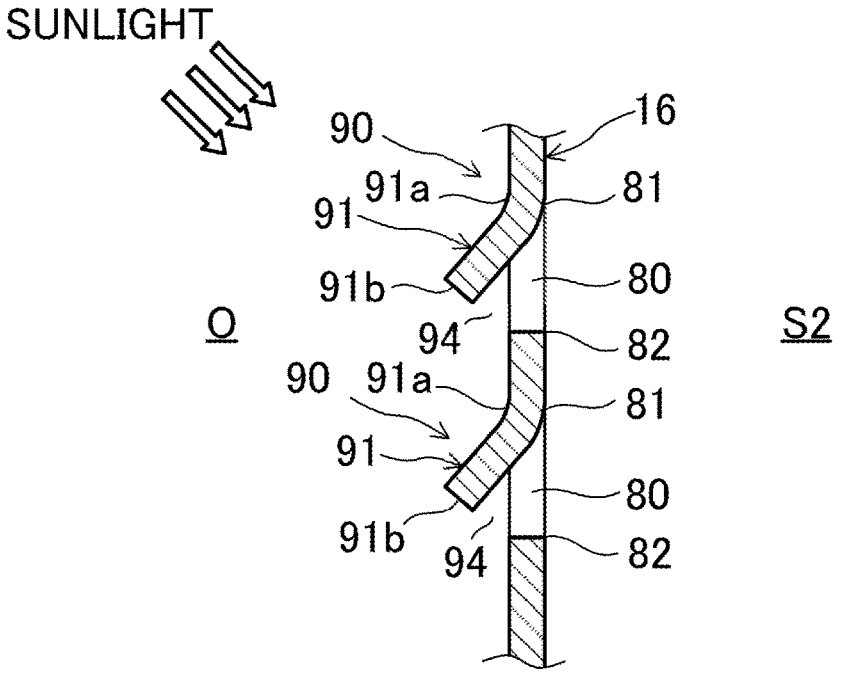
FIG. 9 is a cross-sectional view taken along line IX-IX of FIG. 4.

As illustrated in FIG. 9, a base portion (91*a*) of the eaves portion (91) is integrated with the upper edge portion (81) of the suction port (80). The eaves portion (91) extends downward from the upper edge portion (81) of the suction port (80). The eaves portion (91) of the present embodiment extends downward as a whole. More specifically, the eaves portion (91) extends forward and obliquely downward from the upper edge portion (81) of the suction port (80). There is a gap between the eaves portion (91) and the suction port (80). An inflow port (94) is formed between the lower end (91*b*) of the eaves portion (91) and the lower edge portion (82) of the suction port (80). The inflow port (94) is open downward. Strictly speaking, the inflow port (94) is open forward and obliquely downward.

<Sidewall Portion>

The two sidewall portions include a first sidewall portion (92) and a second sidewall portion (93). The first sidewall portion (92) is provided at the left end of the light shielding portion (90). The second sidewall portion (93) is provided at the right end of the light shielding portion (90). The first sidewall portion (92) extends from the first side edge portion (83) of the suction port (80) to the left end portion of the eaves portion (91). The first sidewall portion (92) protrudes forward and obliquely rightward from the first side edge portion (83). The second sidewall portion (93) extends from the second side edge portion (84) of the suction port (80) to the right end portion of the eaves portion (91). The second sidewall portion (93) protrudes forward and obliquely leftward from the second side edge portion (84).

<Region of Light Shielding Portion>

As illustrated in FIG. 7, the light shielding portion (90) covers at least an upper half of the suction port (80) in a front view. The light shielding portion (90) of the present embodiment covers most of the area of the suction port (80) in the front view. By enlarging the region in which the light shielding portion (90) covers the suction port (80), it is possible to reduce the entry of sunlight into the second space (S2) from the suction port (80).

In the front view of the light shielding portion (90), the lower end of the eaves portion (91) is located higher than the lower edge portion (82) of the suction port (80). In other words, the inflow port (21) and the suction port (80) overlap each other in the plate thickness direction of the front panel (16). Thus, the outdoor air in front of the suction port (80) can be sucked into the second space (S2) through the inflow port (94) and the suction port (80).

Advantages of Embodiment

The eaves portion (91) of the suction port (80) can reduce the entry of sunlight into the second space (S2) through the suction port (80). This facilitates reducing the sunlight reaching the external heat exchanger (32) in the second space (S2), thereby reducing the deterioration of the external heat exchanger (32) caused by sunlight.

The transport container (1) may also be transported to countries where the ultraviolet rays of sunlight are relatively strong. Thus, the exposure of the external heat exchanger (32) to the sunlight would easily cause the deterioration of the external heat exchanger (32). The eaves portion (91) can reduce such deterioration.

The eaves portion (91) is provided on the upper edge of the suction port (80). Thus, the eaves portion (91) can prevent the sunlight from entering from above the suction port (80).

The sidewall portions (92, 93) are provided on lateral sides of the suction port (80). Thus, the eaves portion (91) can prevent the sunlight from entering from lateral sides of the suction port (80).

The eaves portion (91) and the sidewall portions (92, 93) are integrated. Thus, the eaves portion (91) and the sidewall portions (92, 93) can be formed by a press working process or the like. The light shielding portion (90) can be improved in strength with the configuration in which the eaves portion (91) and sidewall portions (92, 93) are integrated.

The suction port (80) is a long hole elongated in the horizontal direction. This configuration can reduce the entry of the sunlight into the suction port (80) while making the forward protrusion of the eaves portion (91) relatively short.

The plurality of first suction ports (80A) are located above the external heat exchanger (32) in the front view. By providing the eaves portion (91) to the first suction port (80A), it becomes possible to reduce the entry of the sunlight coming from above the first suction port (80A) onto the external heat exchanger (32) via the first suction port (80A).

On the surface of the external heat exchanger (32), the cationic coating film is provided. The cationic coating film retards rusting or corrosion of the external heat exchanger (32). The cationic coating film is susceptible to degradation due to sunlight. Thus, the exposure of the external heat exchanger (32) to the sunlight would deteriorate the cationic coating film. To address this deterioration, the eaves portion (91) reduces the entry of the sunlight into the second space (S2), thereby reducing the deterioration of the cationic coating film. As a result, this makes it possible for the cationic coating film to provide long-term retardation of the rusting or corrosion of the external heat exchanger (32).

Variations of Embodiment

The foregoing embodiment may be modified as follows.

<First Variation>

A light shielding portion (90) of a first variation differs from the light shielding portion (90) of the above embodiment in the structure of the eaves portion (91).

Figure 10:
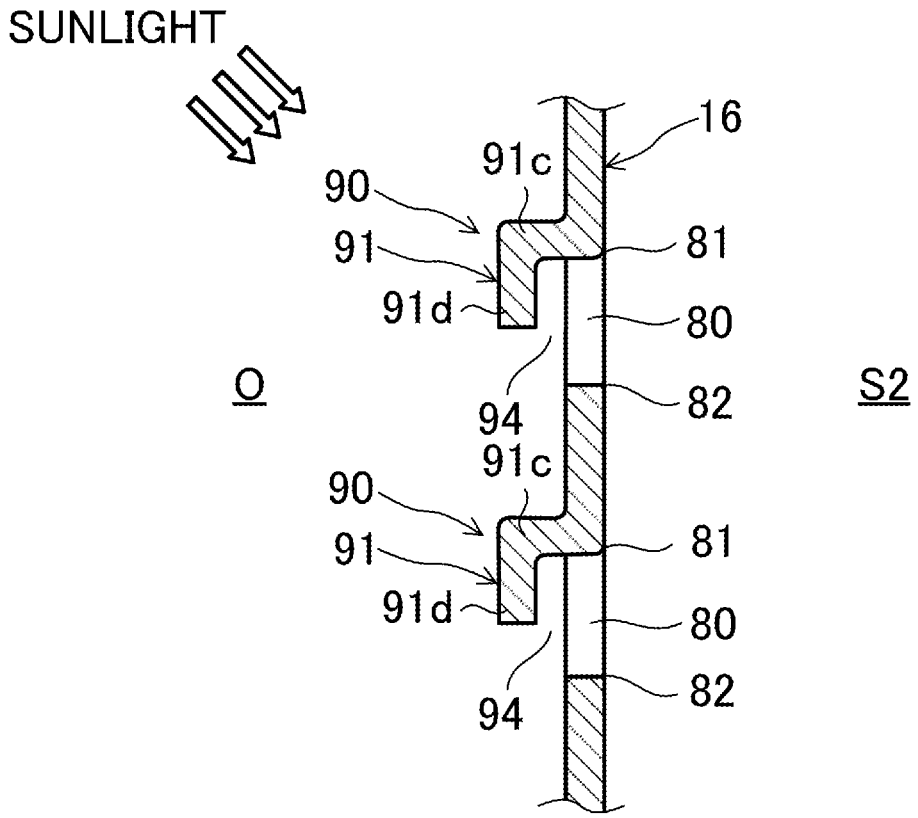
FIG. 10 is a view illustrating a first variation, being equivalent to FIG. 9.

As illustrated in FIG. 10, an eaves portion (91) herein has an upper wall portion (91*c*) and a front wall portion (91*d*). The upper wall portion (91*c*) protrudes from an upper edge portion (81) of a suction port (80) horizontally forward. The front wall portion (91*d*) extends vertically downward from a front edge of the upper wall portion (91*c*). In other words, the first variation is configured such that only a portion of the eaves portion (91) extends downward. The front wall portion (91*d*) is located in front of the suction port (80) and covers at least an upper portion of the suction port (80). An inflow port (94) is formed between a lower edge of the front wall portion (91*d*) and a lower edge portion (82) of the suction port (80).

The first variation with the eaves portion (91) above the suction port (80) can also reduce the entry of the sunlight into the second space (S2) via the suction port (80).

<Second Variation>

Figure 11:
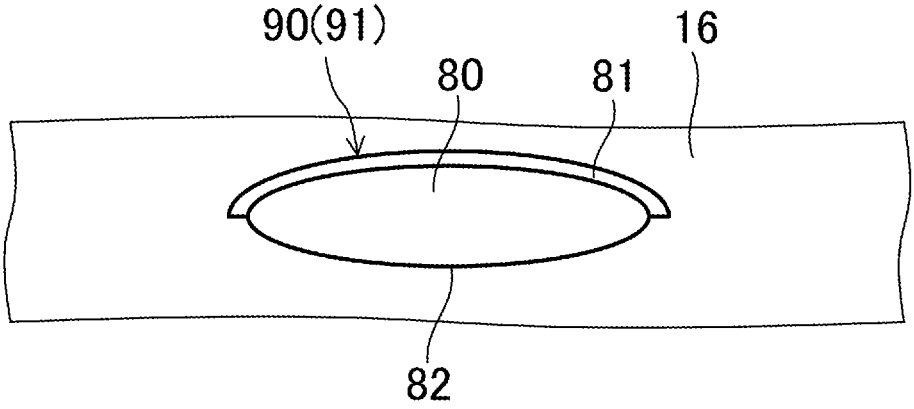
FIG. 11 is a view illustrating a second variation, being equivalent to FIG. 7.

As illustrated in FIG. 11, a suction port (80) of a second variation has an oval shape elongated in the horizontal direction. This configuration is such that an upper-half edge portion of the suction port (80) constitutes an upper edge portion (81). A lower-half edge portion of the suction port (80) constitutes a lower edge portion (82). The eaves portion (91) of a light shielding portion (90) is provided at the upper edge portion (81) of the suction port (80). The eaves portion (91) has a semi-oval shape along the entire upper edge portion (81). The eaves portion (91) is configured to block the sunlight from entering the suction port (80) from above.

Note that the suction port (80) may have a perfect circular shape. Again in this configuration, the upper-half edge of the suction port (80) constitutes the upper edge portion (81). In this configuration, too, in which the lower-half edge of the suction port (80) constitutes the lower edge portion (82), the eaves portion (91) of the light shielding portion (90) is provided at the upper edge portion (81).

Thus, the "upper edge portion" of an opening as described in this disclosure means the edge formed on the upper half of the opening when the shape of the opening has a circular shape, such as an oblong, oval, or perfect circular shape.

<Third Variation>

Figure 12:
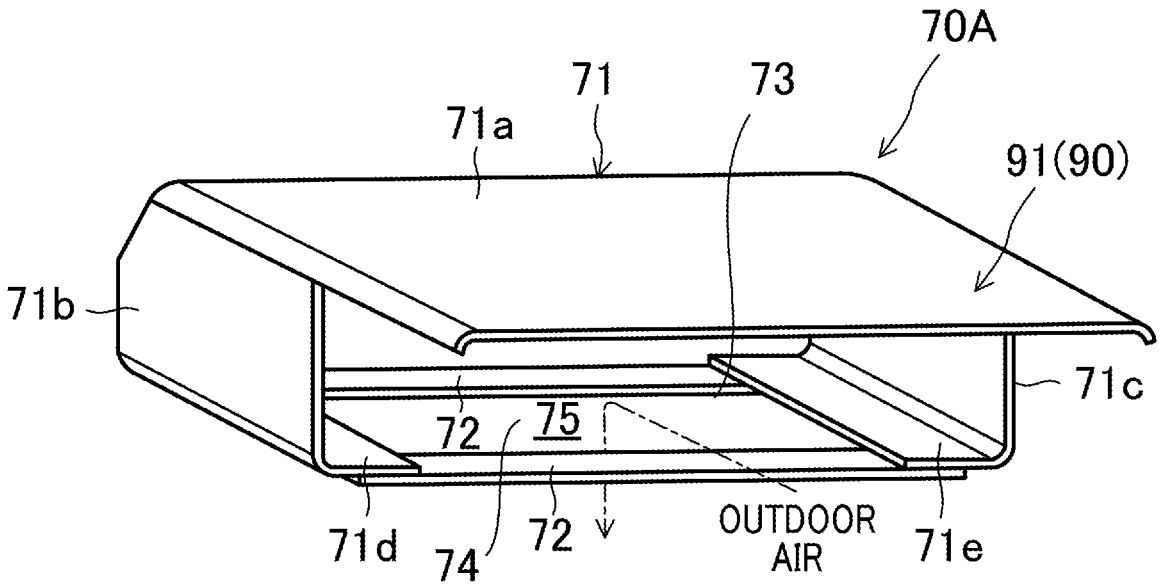
FIG. 12 is a perspective view of a fork pocket according to a third variation.

A third variation illustrated in FIG. 12 is configured such that an eaves portion (91) is provided above an insertion opening (73) of a fork pocket (70). The insertion opening (73) corresponds to an opening for providing communication between the outdoor space (O) and the second space (S2). An eaves portion (91) protrudes forward from the upper plate (71*a*) of the foregoing embodiment, with which the eaves portion (91) is integrated. The upper plate (71*a*) has a substantially rectangular plate-like shape elongated in the horizontal direction. The upper plate (71*a*) corresponds to the upper edge portion of the insertion opening (73). The eaves portion (91) can reduce the entry of the sunlight into the second space (S2) via the insertion opening (73). The eaves portion (91) extends along an axial direction of the tubular shape of the fork pocket (70). This configuration can reduce the possibility that the claw of the forklift may interfere with the eaves portion (91).

Other Embodiments

The above-described embodiments and variations may be modified in the following manner.

The transport container (1) may be used for land transportation. In this case, the transport container (1) is conveyed by a land transporter, such as a vehicle. More specifically, the transport container (1) may be mounted on a trailer.

The external heat exchanger (32) may be a three-side heat exchanger. In this case, the external heat exchanger (32) is configured in a substantially U-shape in the front view. The suction port (80) is located above the external heat exchanger (32) in the front view.

The eaves portion (91) may be provided at a position higher than the upper edge portion of the opening (73, 80).

The light shielding portion (90) may include the eaves portion (91) only, without the sidewall portions (92, 93).

The sidewall portions (92, 93) may be portions separate from the eaves portion (91).

The external heat exchanger (32) may be a three-side heat exchanger configured in a U-shape.

The external heat exchanger (32) may include no cationic coating film on its surface.

While the embodiments and variations thereof have been described above, it will be understood that various changes in form and details may be made without departing from the spirit and scope of the claims. The embodiments, the variations, and the other embodiments may be combined and replaced with each other without deteriorating intended functions of the present disclosure. The ordinal numbers such as "first," "second," "third," . . . , described above are used to distinguish the terms to which these expressions are given, and do not limit the number and order of the terms.

INDUSTRIAL APPLICABILITY

The present disclosure is useful for refrigeration apparatuses for transport and transport containers.

EXPLANATION OF REFERENCES

S2 Second Space (Accommodation Chamber)
1 Transport Container
2 Container Body
10 Refrigeration Apparatus for Transport
11 Casing
16 Front Panel (Partition Portion)
32 External Heat Exchanger (Heat Exchanger)
34 External Fan (Fan)
70 Fork Pocket
73 Insertion Opening (Opening)
80 Suction Port (Opening)
91 Eaves Portion
92 First Sidewall Portion
93 Second Sidewall Portion

The invention claimed is:

1. A refrigeration apparatus for transport, comprising:
a heat exchanger;
a casing forming an accommodation chamber for housing the heat exchanger therein,
the casing being provided with a partition portion extending in a vertical direction so as to partition an outdoor space and the accommodation chamber from each other,
the partition portion having an opening for providing communication between the outdoor space and the accommodation chamber; and
an eaves portion above the opening,
the opening being located above the heat exchanger in the front view,
the refrigeration apparatus comprising a fan arranged inside the heat exchanger,
the partition portion being a front panel located in front of the fan,
the front panel including an outlet grille located in front of the fan,
the heat exchanger surrounding the outlet grille and including a heat-exchange portion corresponding to an upper surface of the heat exchanger, and
the opening including a plurality of openings located above the heat-exchange portion and aligned side by side along the heat-exchange portion, wherein
the plurality of openings is arranged outside and around a perimeter of the heat exchanger in the front view,
the heat exchanger has a heat transfer tube bent so as to surround the outlet grille in the front view, the heat transfer tube has a first portion located above the outlet grille in the front view and a second portion located on a lateral side of the outlet grille in the front view, and the plurality of openings has:

a first set of openings aligned in a direction in which the first portion of the heat transfer tube extends in the front view; and a second set of openings aligned in a direction in which the second portion of the heat transfer tube extends.

2. The refrigeration apparatus for transport of claim 1, wherein the eaves portion is provided at an upper edge of the opening.

3. The refrigeration apparatus for transport of claim 1, further comprising:

sidewall portions on lateral sides of the opening.

4. The refrigeration apparatus for transport of claim 3, wherein the eaves portion has a shape continuous with the sidewall portions.

5. The refrigeration apparatus for transport of claim 1, wherein the opening is a hole elongated in a horizontal direction.

6. The refrigeration apparatus for transport of claim 5, wherein the eaves portion is provided along the opening in the horizontal direction.

7. The refrigeration apparatus for transport of claim 1, wherein the eaves portion includes a portion extending downward.

8. The refrigeration apparatus for transport of claim 1, further comprising:

the fan provided in the accommodation chamber, wherein the opening includes a suction port through which air transferred by the fan is sucked in.

9. The refrigeration apparatus for transport of claim 1, wherein the partition portion has a fork pocket, and the opening includes an insertion opening of the fork pocket.

10. The refrigeration apparatus for transport of claim 1, further comprising:

a coating film on a surface of the heat exchanger, the coating film being made of a cationic paint.

11. A transport container, comprising:

the refrigeration apparatus for transport of claim 1; and a container body.

12. The refrigeration apparatus for transport of claim 2, further comprising:

sidewall portions on lateral sides of the opening.

13. The refrigeration apparatus for transport of claim 12, wherein the eaves portion has a shape continuous with the sidewall portions.

14. The refrigeration apparatus for transport of claim 2, wherein the opening is a hole elongated in a horizontal direction.

15. The refrigeration apparatus for transport of claim 3, wherein the opening is a hole elongated in a horizontal direction.

16. The refrigeration apparatus for transport of claim 4, wherein the opening is a hole elongated in a horizontal direction.

17. The refrigeration apparatus for transport of claim 14, wherein the eaves portion is provided along the opening in the horizontal direction.

18. The refrigeration apparatus for transport of claim 15, wherein the eaves portion is provided along the opening in the horizontal direction.

19. The refrigeration apparatus for transport of claim 16, wherein the eaves portion is provided along the opening in the horizontal direction.

20. The refrigeration apparatus for transport of claim 2, wherein the eaves portion includes a portion extending downward.

21. A refrigeration apparatus for transport, comprising:

a heat exchanger;

a casing forming an accommodation chamber for housing the heat exchanger therein, the casing being provided with a partition portion extending in a vertical direction so as to partition an outdoor space and the accommodation chamber from each other, the partition portion having an opening for providing communication between the outdoor space and the accommodation chamber; and an eaves portion above the opening, in a front view of the partition portion, the opening comprising a plurality of openings with only a first set of openings being located above the heat exchanger and a second set of openings being located left of the heat exchanger, the refrigeration apparatus comprising a fan arranged inside the heat exchanger, the partition portion being a front panel located in front of the fan, the front panel including an outlet grille located in front of the fan, the heat exchanger surrounding the outlet grille and including a heat-exchange portion corresponding to an upper surface of the heat exchanger, and the first set of openings being located above the heat-exchange portion and aligned side by side along the heat-exchange portion, wherein the first and second sets of openings are arranged outside and around a perimeter of the heat exchanger in the front view.

* * * * *